US009525924B2

(12) United States Patent
Slotte

(10) Patent No.: US 9,525,924 B2
(45) Date of Patent: Dec. 20, 2016

(54) MAGNETIC SHIELDING AND COMMUNICATION COIL

(71) Applicant: Microsoft Technology Licensing, LLC, Redmond, WA (US)

(72) Inventor: Benedict Slotte, Turku (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 29 days.

(21) Appl. No.: 14/659,145

(22) Filed: Mar. 16, 2015

(65) Prior Publication Data

US 2016/0277841 A1 Sep. 22, 2016

(51) Int. Cl.
*H04R 1/02* (2006.01)
*H04R 9/02* (2006.01)

(52) U.S. Cl.
CPC ..... *H04R 1/023* (2013.01); *H04R 9/025* (2013.01); *H04R 2209/022* (2013.01)

(58) Field of Classification Search
CPC ... H04R 1/023; H04R 1/086; H04R 2209/022; H04R 2209/024; H04R 9/00; H04R 9/02; H04R 9/025
See application file for complete search history.

(56) References Cited

U.S. PATENT DOCUMENTS 1,997,051 A * 4/1935 Engholm ..... H04R 9/06 381/403
6,526,151 B1 2/2003 Peng
6,546,107 B1 * 4/2003 Bohnke ..... H04R 9/02 361/818
7,397,926 B1 7/2008 Frerking
7,418,106 B2 8/2008 Greuet et al.
7,940,950 B2 5/2011 Shim
8,644,530 B2 * 2/2014 Soininen ..... H04R 1/02 381/189
8,682,014 B2 3/2014 Dave et al.
(Continued)

FOREIGN PATENT DOCUMENTS

WO 2007139318 A2 12/2007
WO 2012063105 A1 5/2012
WO 2016039797 A1 3/2016

OTHER PUBLICATIONS

"International Search Report and Written Opinion Issued in PCT Application No. PCT/US2016/018993", Mailed Date: May 4, 2016, 13 Pages.

(Continued)

*Primary Examiner* — Matthew Eason
(74) *Attorney, Agent, or Firm* — Miia Sula; Judy Yee; Micky Minhas

(57) ABSTRACT

A magnetic coil is described. In an example, an apparatus comprises a layer of porous material and a magnetic coil. The layer of porous material comprises openings configured to pass sound waves through the layer and capture particles having a larger dimension than a width of any of the openings. The magnetic coil is configured on the layer, wherein a signal line of the coil is configured to conform to a shape of the layer so that the signal line is configured on the layer. The coil is configured to change a magnetic field of a transducer and change an orientation of the particles so as to capture the particles on the layer. In other examples, a method and a loudspeaker are described.

20 Claims, 18 Drawing Sheets

(56) References Cited

U.S. PATENT DOCUMENTS

| | | | | |
|---|---|---|---|---|
| 2005/0077102 | A1* | 4/2005 | Banter | H04R 1/086 181/149 |
| 2006/0018498 | A1 | 1/2006 | Hulskemper | |
| 2009/0296947 | A1 | 12/2009 | Duron et al. | |
| 2010/0237976 | A1 | 9/2010 | Li et al. | |
| 2010/0304796 | A1* | 12/2010 | Stohr | H05K 9/0075 455/575.1 |
| 2013/0101149 | A1 | 4/2013 | Maenpaa | |
| 2013/0328648 | A1* | 12/2013 | Kuivallainen | H04B 1/38 335/219 |
| 2014/0056448 | A1* | 2/2014 | Kuivalainen | H04R 1/023 381/189 |
| 2014/0079252 | A1* | 3/2014 | Klein | H04R 1/02 381/152 |
| 2014/0093095 | A1* | 4/2014 | Slotte | H04R 1/02 381/87 |
| 2014/0191838 | A1 | 7/2014 | Yoshida | |
| 2014/0355812 | A1 | 12/2014 | Guo et al. | |

OTHER PUBLICATIONS

"Speakers", Published on: Mar. 26, 2014, Available at: https://www.mtx.com/t/speakers.

"Speakers", Published on: Mar. 26, 2014, 3 pages Available at: https://www.mtx.com/t/speakers.

Second Written Opinion Issued in PCT Application No. PCT/US2016/018993, Mailed Date: Aug. 31, 2016, 5 Pages.

* cited by examiner

MAGNETIC SHIELDING AND COMMUNICATION COIL

BACKGROUND

Typically, mobile devices have at least one means of reproducing audio to the user. This is typically a loudspeaker or a speaker, which is an electroacoustic transducer; a device which converts an electrical audio signal into a corresponding sound. A loudspeaker can be placed inside a mobile device and held near to an ear of the user. This kind of construction is typically called an earpiece or receiver. In the earpiece, the loudspeaker is normally reproducing downlink audio, for example in a hand portable call. A loudspeaker may also be intended to reproduce audio that the user will hear at a distance. This audio may be, for example, ringing signals, music, or downlink speech. This kind of loudspeaker is typically called an integrated hands-free loudspeaker. A loudspeaker is typically a small dynamic loudspeaker. A dynamic loudspeaker normally comprises a permanent magnet, which results in a stray magnetic field being present also outside the loudspeaker. A dynamic loudspeaker normally also comprises a coil situated inside a permanent magnetic field generated by the permanent magnet. This coil is normally called a voice coil. The voice coil is normally attached to a flexible diaphragm. An electrical signal can be fed to the voice coil, which results in sound waves being produced by the flexible diaphragm.

Some mobile devices with earpiece functionality additionally have to be hearing aid compatible, HAC. This means that they also have to be able to provide inductive coupling to hearing aids. In some cases, a dedicated coil is used within the mobile devices for the HAC for achieving the required inductive coupling. In some other cases, the coil inside the loudspeaker itself is sufficient and no additional coil is needed.

Another desire in the design of mobile devices is to protect the delicate components inside mobile devices from damage by the environment. This is also relevant for a loudspeaker, which is more or less in a direct contact with the air outside the body of the device. A typical hazard is produced by ferromagnetic particles, such as ferromagnetic dust, abundant for example in pockets and bags, where also keys, coins and other metal objects may be present. Such dust is attracted by the permanent magnet inside the loudspeaker, after which it accumulates on the sound-generating diaphragm and impedes the function of the loudspeaker. The result is degraded or lost audio, which cannot be restored without sending the mobile device to a repair facility.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

A magnetic coil is described. In one example, an apparatus comprises a layer of porous material and a magnetic coil. The layer of porous material comprises openings configured to pass sound waves through the layer and capture particles having a larger dimension than a width of the openings. The coil is configured on the layer, wherein a signal line of the coil is configured to conform to a shape of the layer so that the signal line is configured on the layer. The coil is configured to change a magnetic field of a transducer and change an orientation of the particles so as to capture the particles on the layer.

In other examples, a method and a loudspeaker is discussed along with the features of the apparatus.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like references are used to designate like parts in the accompanying drawings.

DETAILED DESCRIPTION

The detailed description provided below in connection with the appended drawings is intended as a description of the present examples and is not intended to represent the only forms in which the present example may be constructed or utilized. However, the same or equivalent functions and sequences may be accomplished by different examples.

Although the present examples may be described and illustrated herein as being implemented in a smartphone or a mobile phone, these are only examples of a mobile apparatus and not a limitation. As those skilled in the art will appreciate, the present examples are suitable for application in a variety of different types of mobile apparatuses, for example, in tablets, phablets, computers, cameras, etc. Although the examples shown herein discuss the application of embodiments where the electroacoustic transducer is a loudspeaker (in other words converting electrical or electronic signals into acoustic waves), it should be understood that in some embodiments the electroacoustic transducer is a microphone converting acoustic waves into electrical or electronic signals.

Figure 1:
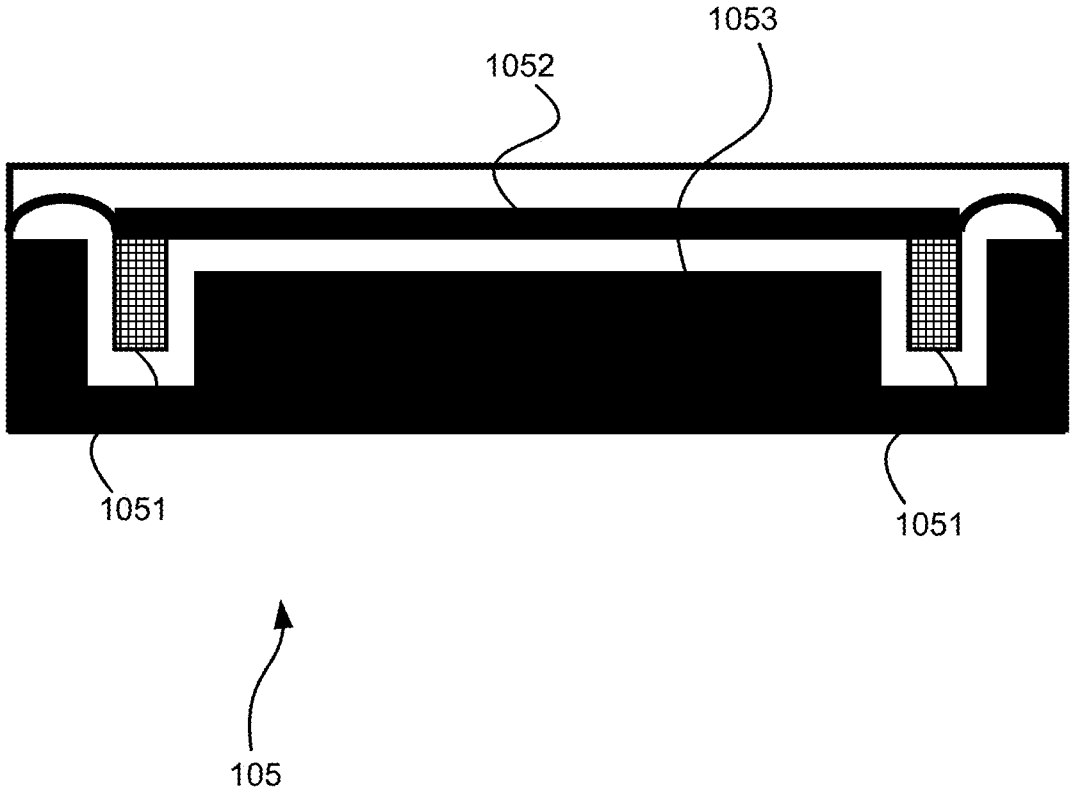
FIG. 1 illustrates a cross section of a loudspeaker, in accordance with an illustrative example.

FIG. 1 illustrates an example of a cross section of a loudspeaker 105. FIG. 1 is a simplified cross section of a loudspeaker 105, which may be an example a typical mobile device loudspeaker. The loudspeaker 105 includes a voice coil 1051, a diaphragm 1052, and a magnet system 1053. An electric signal is connected to the voice coil 1051, which in combination with other features of the loudspeaker 105, results in a production of a sound. The loudspeaker 105 may be a part of an electronic device. As discussed, the loudspeaker 105 is an electroacoustic transducer; a device which converts an electrical audio signal into a corresponding sound. Examples of the loudspeaker 105 may be an integrated loudspeaker such as an integrated hands free loudspeaker, IHF, or an earpiece. In some embodiments, the loudspeaker 105 can be any suitable loudspeaker type comprising a permanent magnet. Additionally or alternatively, the loudspeaker 105 comprises a multifunction device, MFD, component having any of the following: combined earpiece, integrated handsfree speaker, vibration generation means or a combination thereof. The loudspeaker 105 may be a part of an apparatus. Examples of the apparatus may be an earpiece device, a hearing aid device, a part of a mobile device, a part of an electronic device, etc.

Figure 2:
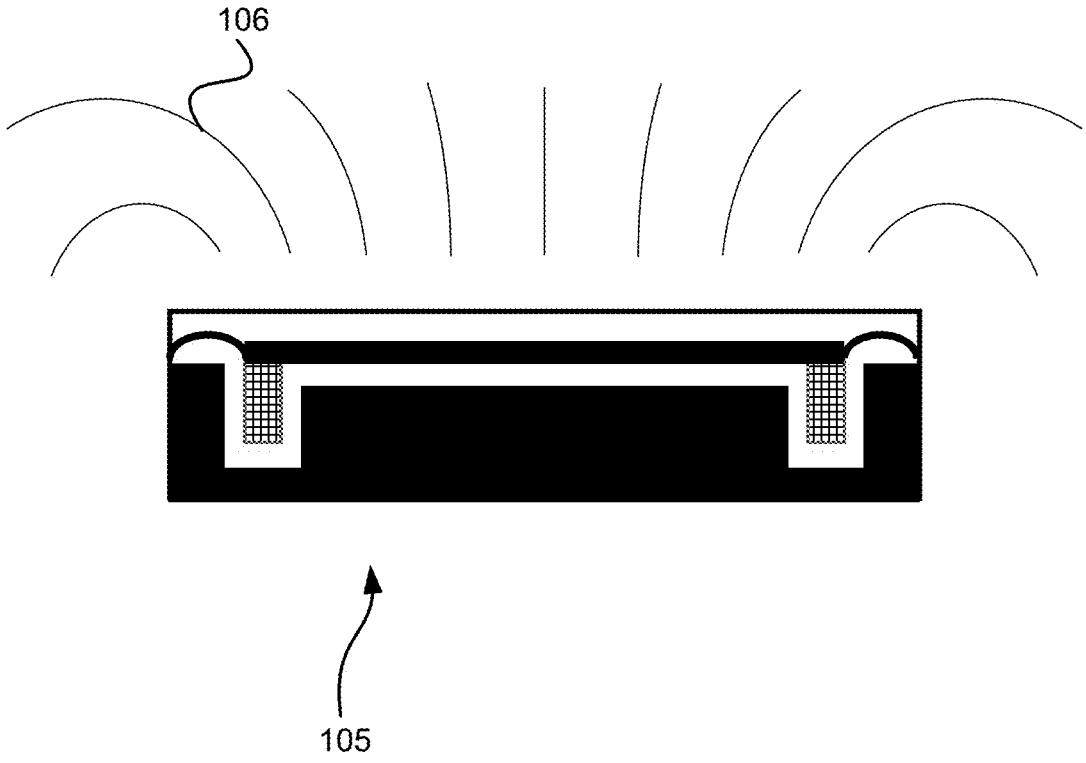
FIG. 2 illustrates a magnetic field of a loudspeaker, in accordance with an illustrative example.

FIG. 2 illustrates an example of magnetic field lines 106 of a loudspeaker 105. The magnetic field may also be referred to as magnetic field lines. In the example of FIG. 2 only a region having the magnetic field 106 above the loudspeaker 105 is shown. The magnetic field 106 may be generated by the voice coil 1051 inside the loudspeaker 105, when an audio signal is fed to the voice coil 1051. This magnetic field 106 can be used to reproduce an audio signal for a hearing aid. This example is used in some cases, and in other cases a separate HAC coil may be used to generate a magnetic field for the hearing aid. Furthermore, a magnetic field 106 may be generated by the magnet system 1053 inside the loudspeaker 105. This may be referred also as a static stray magnetic field. This magnetic field 106 is usually undesired, since it attracts ferromagnetic particles, such as ferromagnetic dust, to the loudspeaker 105. Both magnetic fields, a magnetic field of the hearing aid coil and a magnetic field of the magnet system 1053 (the stray magnetic field), can be present during the operation of the loudspeaker 105. The stray magnetic field is always present, and the magnetic field from the voice coil is also present when a signal is fed to it.

Figure 3:
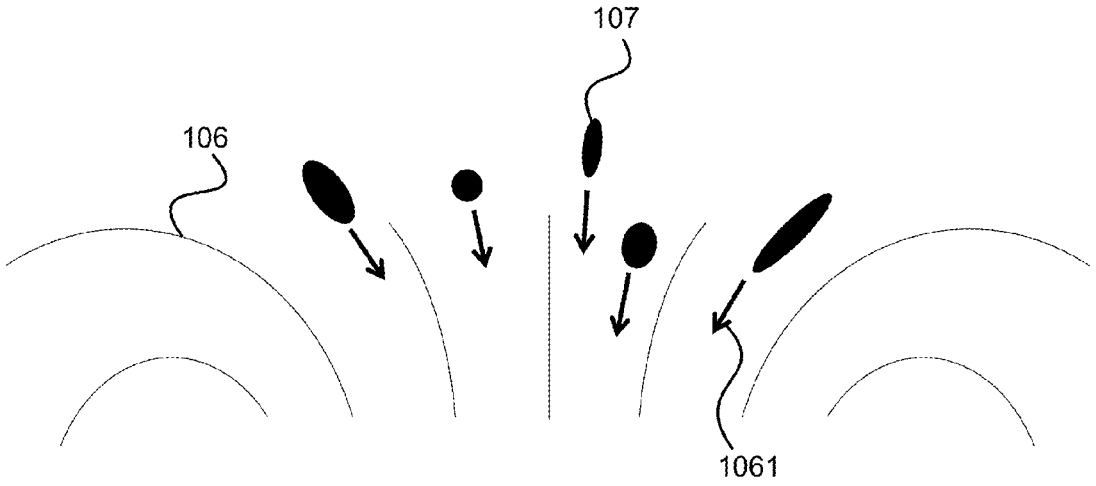
FIG. 3 illustrates particles in a magnetic field of a loudspeaker, in accordance with an illustrative example.

FIG. 3 illustrates particles in ferromagnetic particles 107 in magnetic field lines 106 of a loudspeaker 105 in accordance with an illustrative example. Ferromagnetic particles may be elongated. Ferromagnetic particles 107 are shown in a static magnetic field. Ferromagnetic particles 107 tend to orient themselves along the magnetic field lines 106. Ferromagnetic particles 107 get pulled in a direction of the field gradient, for example toward regions where the magnetic field lines 106 are denser. A pulling force 1061 is shown in the FIG. 3. In the figures the size of the ferromagnetic particles 107 has been enlarged for clarity.

Figure 4:
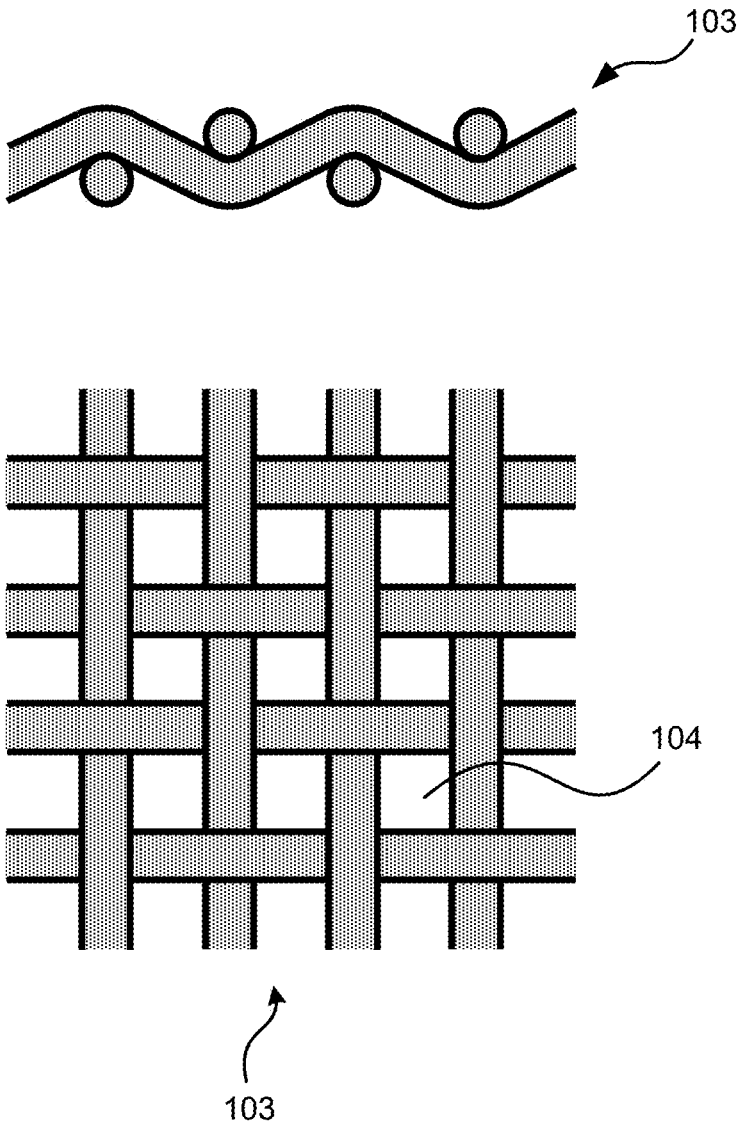
FIG. 4 illustrates an example of a layer of porous material.

FIG. 4 illustrates an example of a layer of porous material 103. In some examples, the layer of porous material 103 may be referred to as a dust net or a dust mesh. FIG. 4 shows two views of the layer 103: a cross section above and a top view below. A structure of woven dust mesh is shown in detail in FIG. 4. A weaving pattern may be different than shown in FIG. 4. The porous layer 103 operating as a dust shield may alternatively be open cell foam, sintered, felt, or any other woven or nonwoven material. The layer 103 includes an opening 104. Ferromagnetic particles, which are larger than a size of the opening 104, may be blocked. A width of the openings 104 may be such that the elongated particles 107 do not fit into the opening, except when they are generally perpendicular with respect to the layer 103, and the end of the elongated particles 107 is facing the opening 104. The layer 103 may be a mechanical protective means. It can be used to mechanically protect the electronics components from the particles 107. Sound may pass through the layer 103, for example as it is porous, and/or comprises openings 104. The openings 104 can be conduits or acoustic windows and permit acoustic or sound waves to pass between the environment or exterior of the loudspeaker 105 and the interior of the loudspeaker 105.

Figure 5:
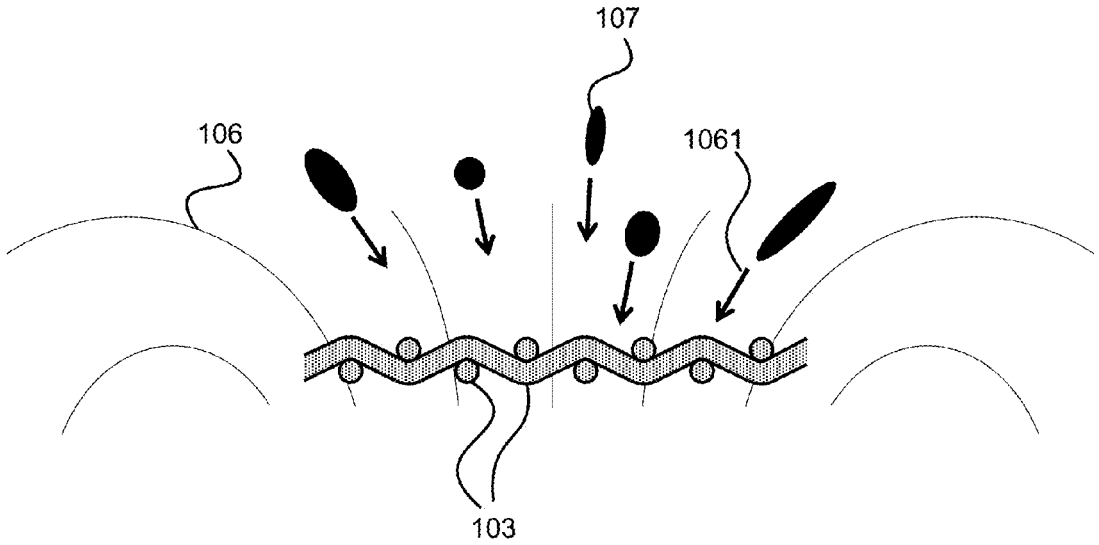
FIG. 5 illustrates a cross section of a layer of porous material and a magnetic field of the loudspeaker, in accordance with an illustrative example.

FIG. 5 illustrates a cross section of the layer of porous material 103 and the magnetic field lines 106 and the particles 107. The layer 103 is blocking the ferromagnetic particles 107, which are pulled in by the magnetic field 106 by the pulling force 1061. It is seen that the orientation of the magnetic field lines 106 relatively easily helps particles get through, even if one of their dimensions is larger than the openings 104 in the layer 103. This is due to the ferromagnetic particles 107 being typically elongated and magnetically configurable such that they are oriented generally in parallel to the magnetic field lines 106.

Figure 6:
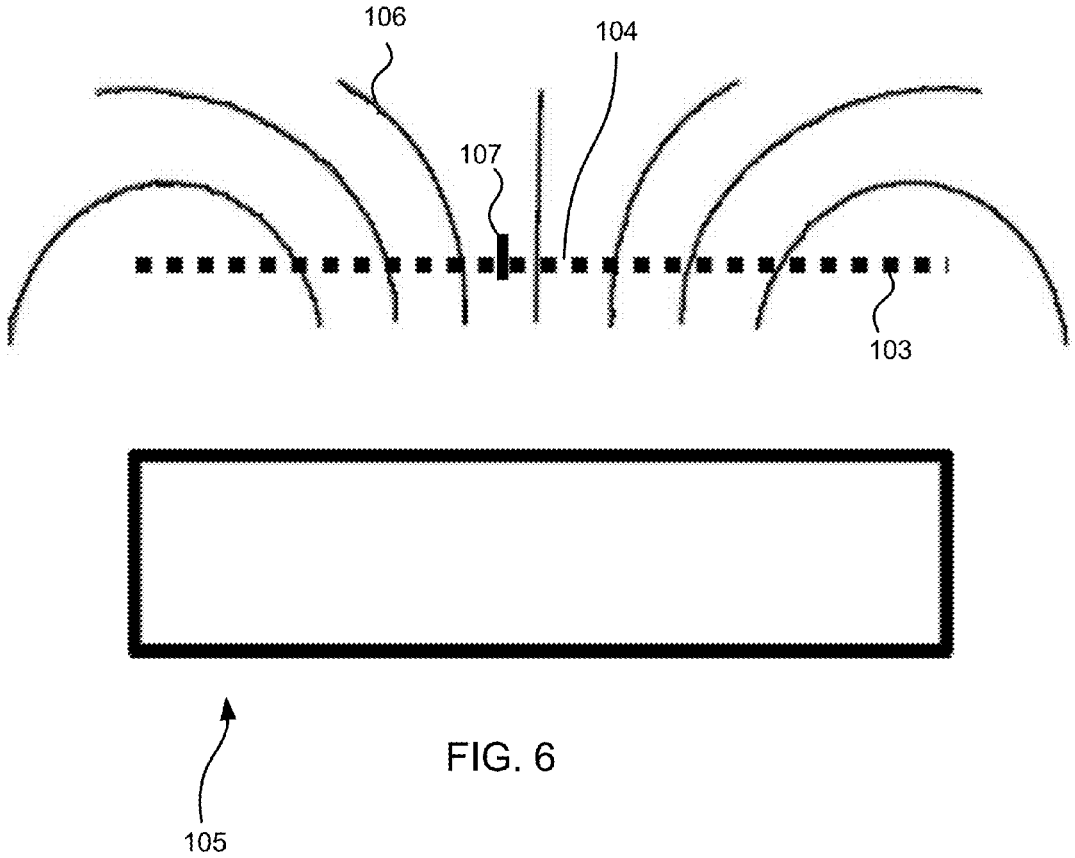
FIG. 6 illustrates a cross section of a loudspeaker, a layer of porous material, and a magnetic field of the loudspeaker, in accordance with an illustrative example.

FIG. 6 illustrates a cross section of a loudspeaker 105, a layer of porous material 103, and magnetic field lines 103 of the loudspeaker 105, in accordance with an illustrative example. The example of FIG. 6 illustrates a typical case showing the shape of the magnetic field 106. It should be noted that the shape may depend on the internal constructions of the loudspeaker 105. The example of FIG. 6 illustrates how the magnetic field lines 103 may be oriented fairly perpendicularly with respect to the layer of porous material 103. Elongated ferromagnetic dust particles 107 may align themselves with the magnetic field lines 103. This means that such dust goes through the layer of porous material 103 quite easily as illustrated in FIG. 6. Even if one dimension of the particle 107 is greater than a width of an opening 104 of the layer 103, the particle 107 passes through the layer due to the orientation, which is caused by the magnetic field 103. For example, the end of the dust particle having a smaller diameter may pass through the dust net.

Figure 7:
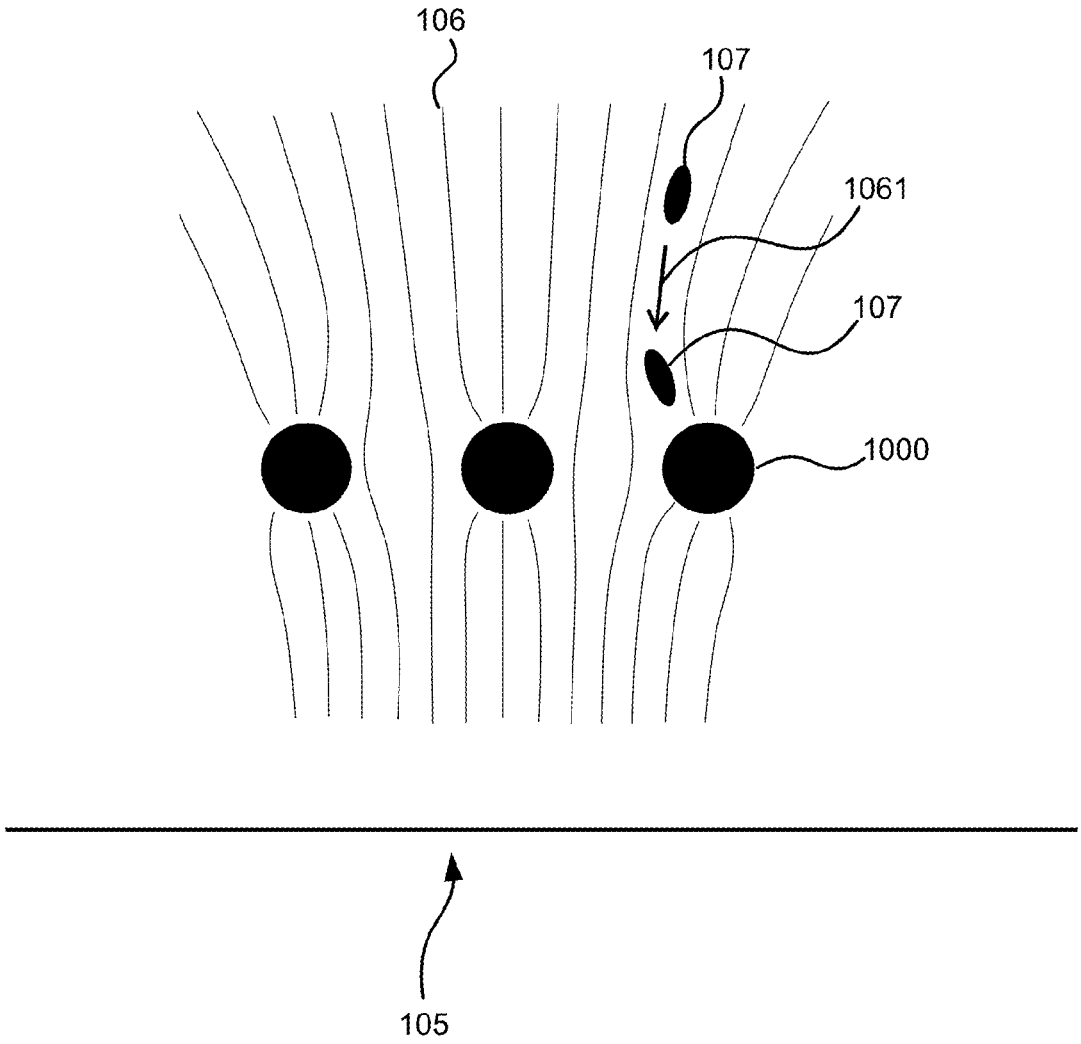
FIG. 7 illustrates a cross section of a high permeability material in a magnetic field of a loudspeaker, in accordance with an illustrative example.

FIG. 7 illustrates an example of a cross section of a high permeability material 1000 in magnetic field lines 106 of a loudspeaker 105. FIG. 7 shows a cross-section of threads of a high-permeability material 1000 in the magnetic field 106. For example a cross section of signal lines of a coil or a cross section of threads of a porous sheet may be shown. The magnetic field 106 is attracted by the high-permeability material 1000, which also means that the magnetic field lines 106 tend to bend toward the material 1000. As a result, approaching ferromagnetic particles 107 are also rotated, and the magnetic field 106 above the material 1000 is significantly reduced (FIG. 7 shows only the directions of field lines 106, but not the magnitude (strength) of the magnetic field).

Figure 8:
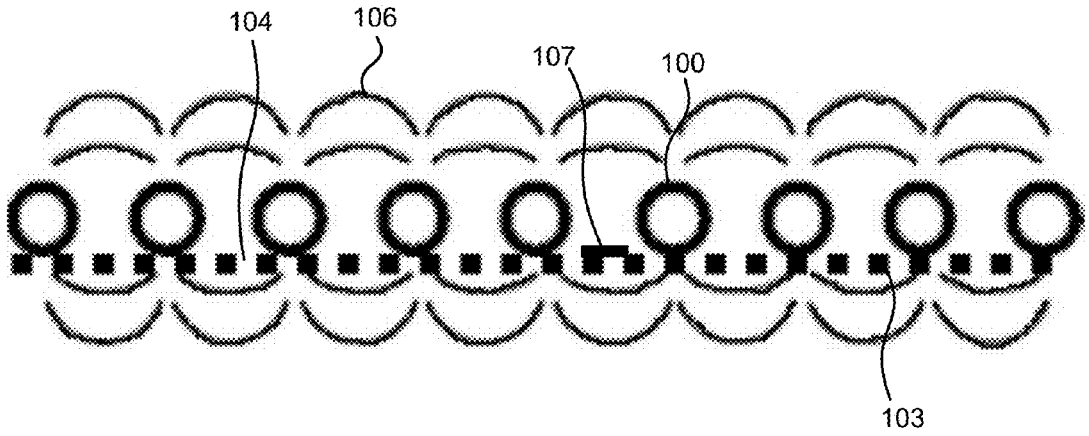
FIG. 8 illustrates a coil, a layer of porous material, and a magnetic field of the loudspeaker, in accordance with an illustrative example.

FIG. 8 illustrates a similar cross section as in the example FIG. 6, but with a coil 100, which is being added on the layer of porous material 103. For example, a high-permeability metal coil may be added on the dust net. For the sake of illustration only, the magnetic field lines 106, which are very close to the coil 100, are shown in FIG. 8. In the example of FIG. 8, some of the magnetic field lines 106 are now oriented more in parallel with respect to the layer of porous material 103. In FIG. 8 the magnetic field lines 106 are, for the sake of illustration purposes only, shown to orientate in parallel with the coil 100 and the layer 103. It should be noted that the magnetic field lines 106 may not necessary be parallel, for example as shown in the example of FIG. 7. The magnetic field lines 106 may be more sucked into the coil 100, for example becoming more parallel to the layer 103. Consequently, an elongated dust particle 107 collides more sideways with the layer 103 as illustrated in FIG. 8. The particle 107 does not fit into the opening 104 of the layer 103 and does not pass through it. In one example, some of the particles 107 may stick to the coil 100 rather than pass into the loudspeaker 105. The dust protection may be improved.

Furthermore, although figures are shown such that the magnet of the loudspeaker 105 is located below the dust net, it should be understood that the terms "above" and "below" are simply reference directions and do not limit the embodiments of the application to any particular alignment or directional orientation. The order of layer 103, the coil 100 and any possible further layer may vary.

Although the present examples in the figures illustrate a single-layer planar coil, the coil 100 may include more than one layer. For example, the coil 100 can be configured with multiple layers, as long as the layers are aligned or separated so that the sound can pass through it, for example air can flow through it. The coil layers may be directly on top of each other, or there may be a layer of porous material 103 or a layer of ferrite between the coil layers.

According to an example, the coil 100 is configured to a communication signal and further configured to act as a magnetic shield. A single coil 100 is configured for both purposes. This can save costs and space within the mobile device. The geometry of the coil 100 is configured to change the orientation of the magnetic field 106. This may take place close to the layer of porous material 103. The magnetic field is oriented in such a way that elongated particles 107 tend to orient themselves more in parallel, rather than perpendicularly, with respect to the layer 103. This may block such particles 107 more efficiently than a plain dust mesh. Furthermore, this may reduce the risk of loudspeaker failures. Even further, this may lead to fewer repairs, etc.

According to an example, the coil 100 may be constructed as a planar rectangular coil made of a high-permeability electrically conductive material, for example, a thin thread of SUS 430 steel. The coil 100 may be shaped to cover the layer of porous material 103. For example, the coil 100 is configured on a dust net at the front of the earpiece loudspeaker. The dust net may be normally required in front of the loudspeaker. The layer 103 acts as an acoustically transparent backing to which the coil 100 can be attached.

The coil 100 may make the layer of porous material 103 stiffer. In an example, due to the coil 100 attached on the dust net, the dust net may be more robust. Consequently, this may reduce its tendency to vibrate and produce audible distortion. The dust net vibrates only slightly when air flows to and from the loudspeaker diaphragm as it is generating sound. Consequently, the dust net requires smaller clearances above and below it, in order to prevent undesired collision with the parts of the loudspeaker and anything else in close proximity to the dust net. Furthermore, the coil 100 can use the layer of porous material 103 as a backing, for example, to maintain its shape. Consequently, no additional layer is needed for this purpose. The coil 100 can be provided directly on the layer of porous material 103. For example, the coil 100 may be attached, glued, printed or deposited on the layer 103. The layer of porous material 103, such as the dust net, is configured to protect the loudspeaker 105 from dust by employing a dense enough mechanical protection in front of the loudspeaker 105. The protection can be improved by a magnetic shield of the coil 100. The magnetic shield acts to reduce the stray magnetic field 106 generated by the magnet system inside the loudspeaker 105. This may reduce the force that attracts dust in the first place. Furthermore, the change of the orientation can improve the protection by orienting particles 107 so that they are better caught by the layer of porous material 103.

One of the layers may have small enough openings so as to work as a dust filter. This duty may be achieved by the layer 103 of porous material. The layer 103 of porous material may capture the particles. If there are several layers, some of the other layers may have larger openings.

The coil 100 is configured to a communication signal. For example, the coil 100 is configured to a HAC signal, or the coil 100 is configured to a NFC signal. Consequently, the coil 100 can act as hearing aid coil, which may be alternatively referred to as a feature available on many hearing aids and called telecoil. It is also referred to as a t-switch or t-coil. It is a coil of wire that will induce an electric current in the coil when it is in the presence of a changing magnetic field. The coil 100 can therefore be an alternate or supplemental input device for a hearing aid. Normally, a hearing aid listens with its microphone, and then amplifies what it hears. However, with the coil 100 used as the input source instead of, or in addition to, the microphone, the hearing aid can "hear" a magnetic signal, which represents sound.

Originally, the telecoil was meant to "hear" the magnetic signal naturally generated in an older telephone, whose loudspeaker was driven by powerful magnets. This allowed someone with a hearing aid to hear the telephone better, if they just turned on (or switched to) their telecoil as an input source for their hearing aid. Now there are many more magnetic sources that can be "heard" by a telecoil equipped hearing aid. Even though newer phones are not natural sources of a magnetic signal, most phones contain extra electronics to generate a magnetic signal and are thus hearing aid compatible, HAC. Consequently, the coil 100 is configured to "hear" the magnetic signal they put out. In addition, for example due to the Americans with Disabilities Act, ADA, many public accommodations such as movie theaters, theaters, auditoriums, and sports stadiums provide assistive listening systems, ALSs, which may include headsets or receivers loaned to patrons to help them hear. Many of these are HAC so that the coil 100 can be configured to a signal from them.

The coil 100 may be configured to a NFC signal. For example, the coil 100 may act as an NFC coil or antenna used for data transmission, for example.

In an example, a porous material of the layer 103 does not have a high permeability. The coil 100 is formed on the layer 103 of porous material. The coil 100 is made of a conductive high-permeability material. In another example, the porous material of the layer 103 has a high permeability. The coil 100 is formed on the layer 103 of porous material. The coil 100 is made of a conductive material, whose permeability may, or may not, be high. In still another example, the porous material of the layer 103 does not have a high permeability. An extra layer of porous high-permeability material is added. On top of the extra layer, the coil 100 is added. The coil 100 is made of a conductive material, whose permeability may, or may not, be high. Other materials and configurations of the layer 103 and coil 100 capable of providing the desirable permeability, as well as other ordering of the layers, are also possible according to the requirements of the apparatus.

Figure 9:
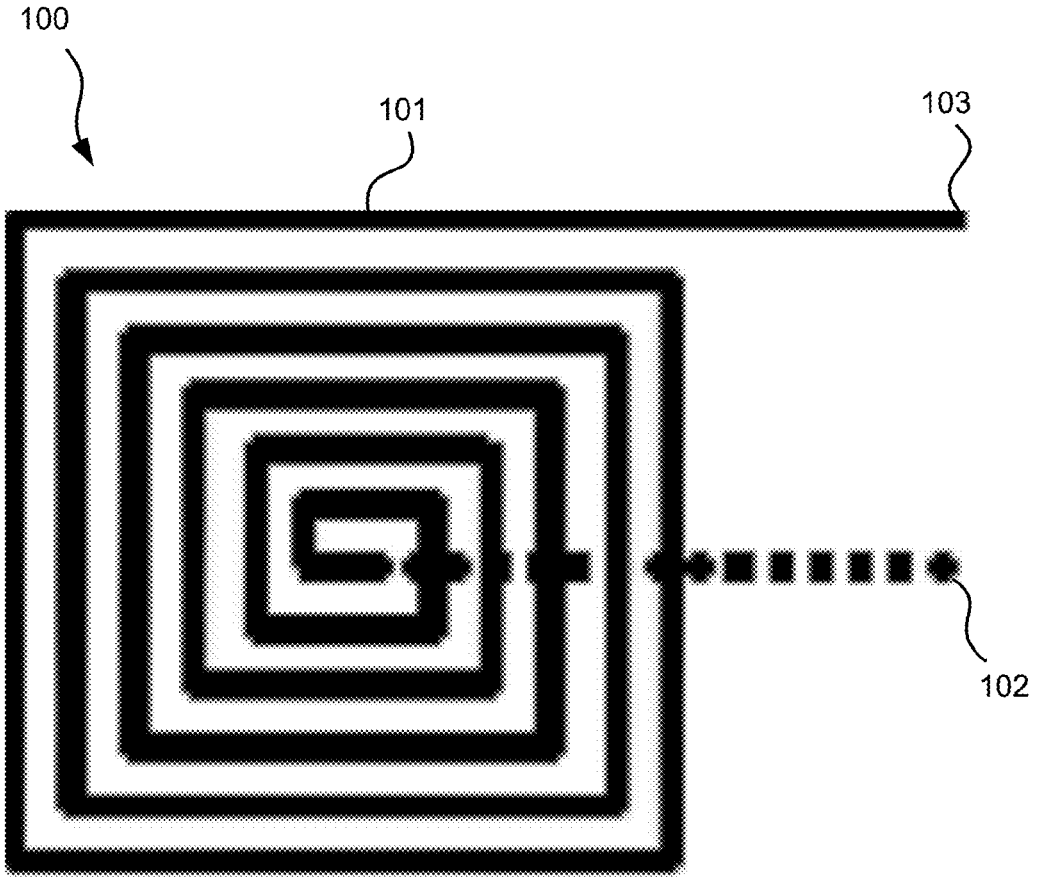
FIG. 9 illustrates geometry of a coil in accordance with an illustrative example.

FIG. 9 illustrates an example of geometry of a coil 100. A signal line 101 of the coil 100 is shown in FIG. 9. The signal line 101 of the coil 100 is configured to operate as an electric converter converting a signal current to an electromagnetic field. The geometry of the signal line 101 and accordingly the coil 100 is configured such that an orientation of elongated particles 107 can be changed. This is due to a local change in the magnetic field of the loudspeaker 105, which is caused by the coil 100. The signal line 100 is of a spiral configuration, as for example shown in FIG. 9. This may cause a reasonable change in the orientation. Furthermore, this may provide a reasonable coverage of the coil 100, when the coil 100 is attached on a layer of porous material 103. An even and thorough coverage may be obtained by the spiral geometry of the signal line 101 on the layer of porous material 103. Connection points 102, 103 for the signal of the signal line 101 are shown by the protruding wires in FIG. 9. With the connection points 102,103, the coil 100 can be connected to a signal source or destination, for example a HAC or NFC device, etc. A dashed line in FIG. 3 illustrates a wire that lies in a different plane than the rest of the signal line 101, for example below or above it. In FIG. 9, the coil 100 is of a square shape. Furthermore, the coil 100 is planar in the example of FIG. 9.

Figure 10:
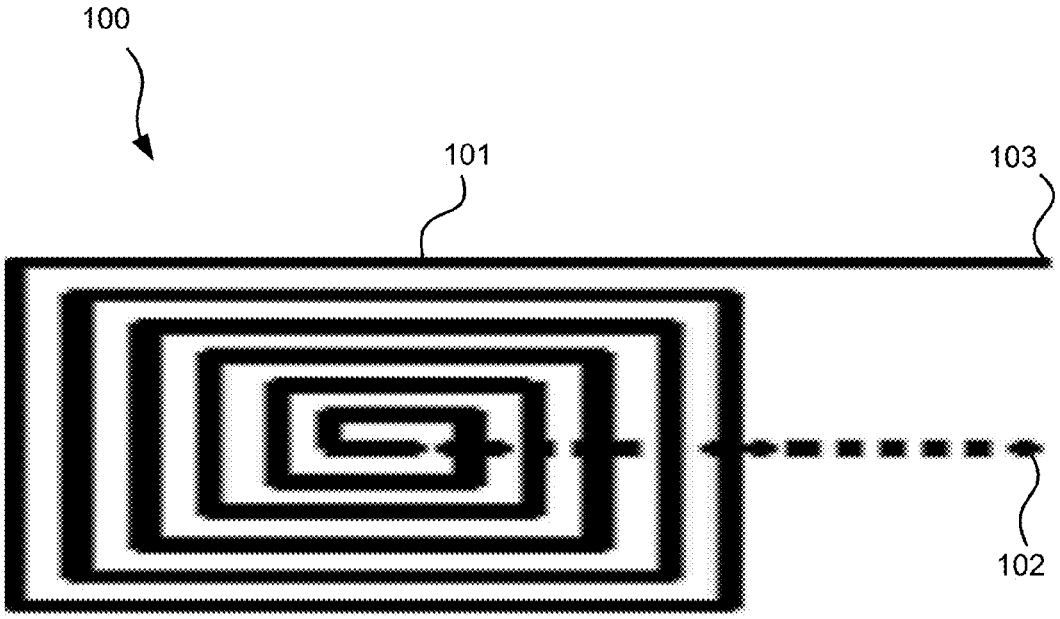
FIG. 10 illustrates geometry of a coil in accordance with another illustrative example.

FIG. 10 illustrates another example of geometry of the coil 100. In the example of FIG. 10, the geometry of the coil 100 is configured rectangular, for example to have a rectangular planar shape. The coil 100 may conform to the shape and geometry of the layer of porous material 103. For example, small loudspeakers which are used in mobile devices are usually rectangular. In some examples, dimensions of an earpiece loudspeaker may be 6*12 mm, 6*15 mm, 8*12 mm.

FIG. 9 and FIG. 10 illustrate examples of a simplified planar coil. According to another example, the number of turns may be greater or smaller than shown in these figures. According to another example, the corners of the spiral can be rounded in order to avoid breaking the signal line 101. According to another example, the coil 100 can extend beyond the layer of porous material 103. For example, the coil 100 is larger than the layer of porous material 103, because larger inductive coupling and a bigger coil is required. According to another example, the coil 100 may be smaller than the layer of porous material 103. For example, the dust net fits to the mechanical structure of the loudspeaker and there is no need to make the coil 100 as large as the dust net. This may be due to the smaller coil 100 already achieving good weakening of the magnetic field 106 as well as the changed orientation of the particles 107.

Although the above examples and figures illustrate a square or rectangular shaped coil 100 and the layer 103, it should be noted that a circular or an oval constructions may be used as well. For example, the loudspeaker 105 may be circular or oval, as well as the coil 100 and the layer of porous material 103, and any additional layer on the loudspeaker 105.

Although the above examples and figures illustrate a spiral shaped coil 100, another kind of shapes may be used for the coil 100. For example, the shape may dependent on the used radio frequency of the communication signal. Spiral may be designed for low-frequency signals such as HAC. High-frequency signals may have different kind of shapes, being more suitable for the high-frequency signals.

The material of the signal line 101 of the coil 100 may be any material, which can be worked for the geometry of the coil 100 and which provides the magnetic effect affecting the magnetic field 106 of the loudspeaker 105 and which can be configured to the communication signal. For example, the coil 100 can be metal. Magnetic shielding properties are shown by any materials having a high relative magnetic permeability. One example of a common material with such properties is stainless steel of grade SUS 430. Certain stainless steels have this property. Another alternative is so-called mu metal. Also ferrite, for example as used in some coils to increase their inductance, has similar shielding properties. Furthermore, the coil 100 may be made of a conventional metal material rather than high-permeability material.

According to an example, inductance values of about 2-5 μH can be achieved using a thread 101 thickness, and thread distance, of 0.05 mm. This may be much less than the inductance of a conventional dedicated HAC coil. Consequently, the corresponding loss in the performance may be compensated for by using a higher driving current for the coil 100. It may also be compensated for by adding a layer of high-permeability material. According to another example, for maximizing magnetic shielding efficiency, and thus also the dust protection, the total volume of the high-permeability material may be as large as possible. Consequently, the wire 101 may be thick in this example. According to another example, a compromise between an achievable HAC or NFC performance and a magnetic shielding performance can be achieved between these two examples.

Figure 11:
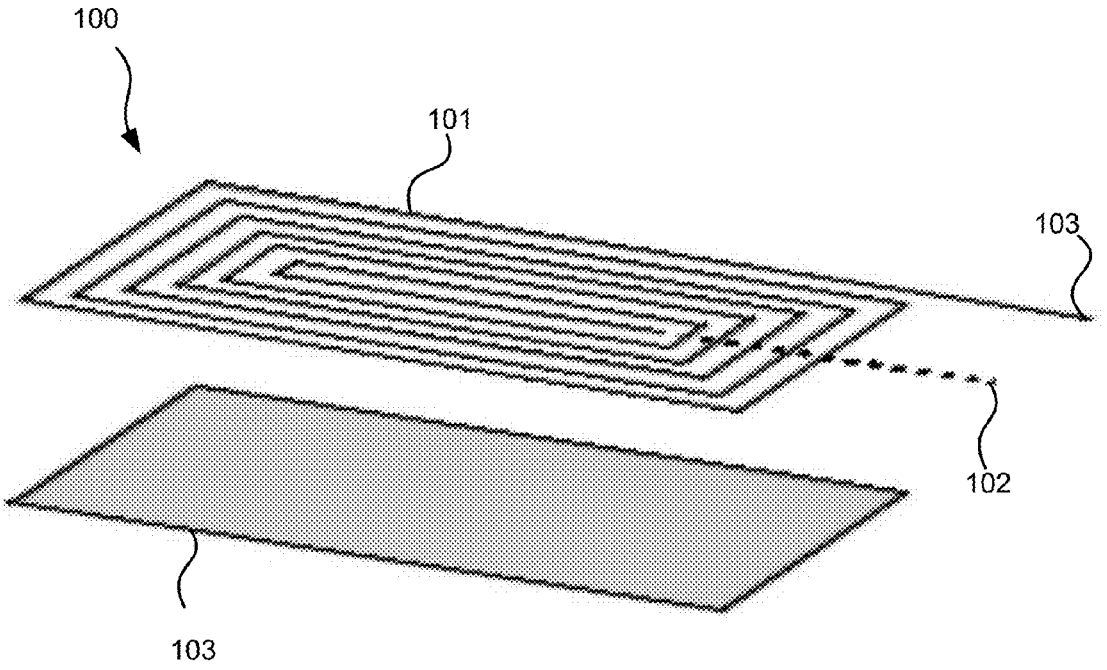
FIG. 11 illustrates a coil and a layer of porous material, which are shown separately, in accordance with an illustrative example.
Figure 12:
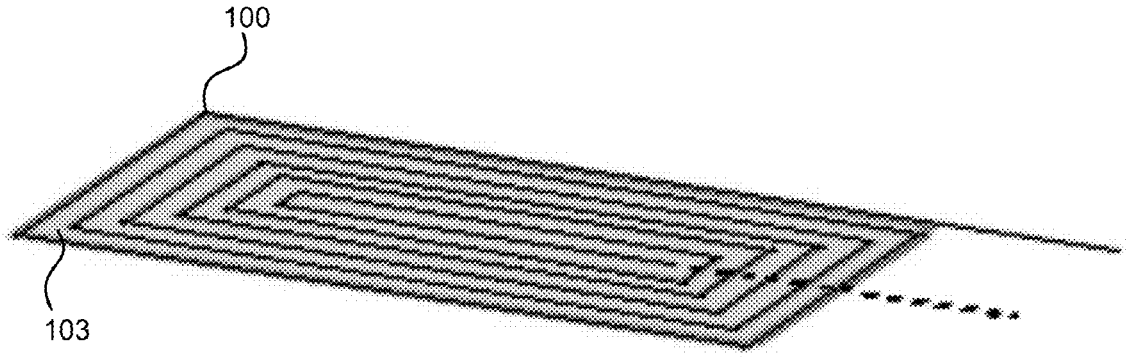
FIG. 12 illustrates a coil attached on a layer of porous material, in accordance with an illustrative example.

FIG. 11 shows an example of a coil 100 and a layer of porous material 103, which are shown separately. In the example of FIG. 12, the coil 100 is attached on the layer of porous material 103. For example, a planar coil and a dust mesh are laminated as a single part.

The coil 100 can be attached on the layer of porous material 103 in various ways. For example, the coil 100 can be glued on the layer 103. The signal line 101 of the coil 100 may also be deposited on the layer 103. For example, micro-electrical deposition methods may be used to deposit the signal line 101 on the layer 103. For example, an electronics printing method may be applied to deposit the signal line 101. The signal line 101 of the coil 100 can be a normal wound wire, printed, or cut from a sheet, or formed in any other suitable way. Furthermore the coil 100 and the signal line 101 can also be embedded into the porous layer 103.

The coil 100 can be on top of the layer of porous material 103. For example, the coil 100 is on the layer 103 so that the coil 100 is facing away from the loudspeaker 105 and the layer 103 is facing the loudspeaker 105. According to another example, the coil 100 is situated below the layer 103. For example, the coil 100 is on the layer 103 so that the coil 100 is facing the loudspeaker and the layer 103 is facing away from the loudspeaker. The order of layers may vary. According to another example, the layer 103 is situated between the coil 100 and a second coil (not shown in the figures). For example, the layer 103 may be sandwiched between the coils. According to an example, at least one further layer of porous material may be added.

Figure 13:
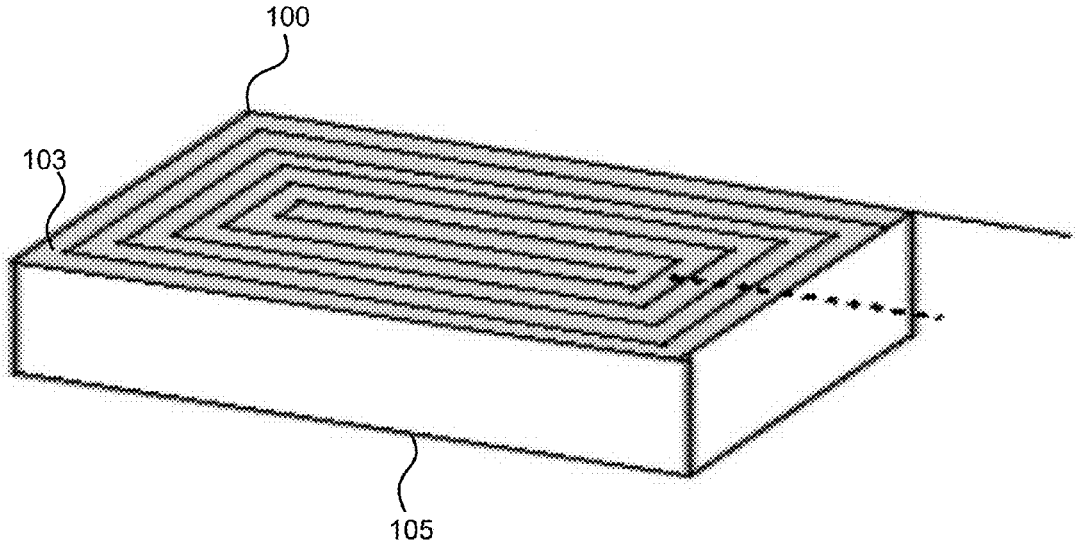
FIG. 13 illustrates a coil and a layer of porous material added on a loudspeaker, in accordance with an illustrative example.

FIG. 13 shows an example of the coil 100 and the layer of porous material 103 added on a loudspeaker 105. The combined coil 100 and layer 103 are added on top of the loudspeaker 105. The sound-generating diaphragm of the loudspeaker 105 may be located below the combined coil 100 and layer 103.

Figure 14:
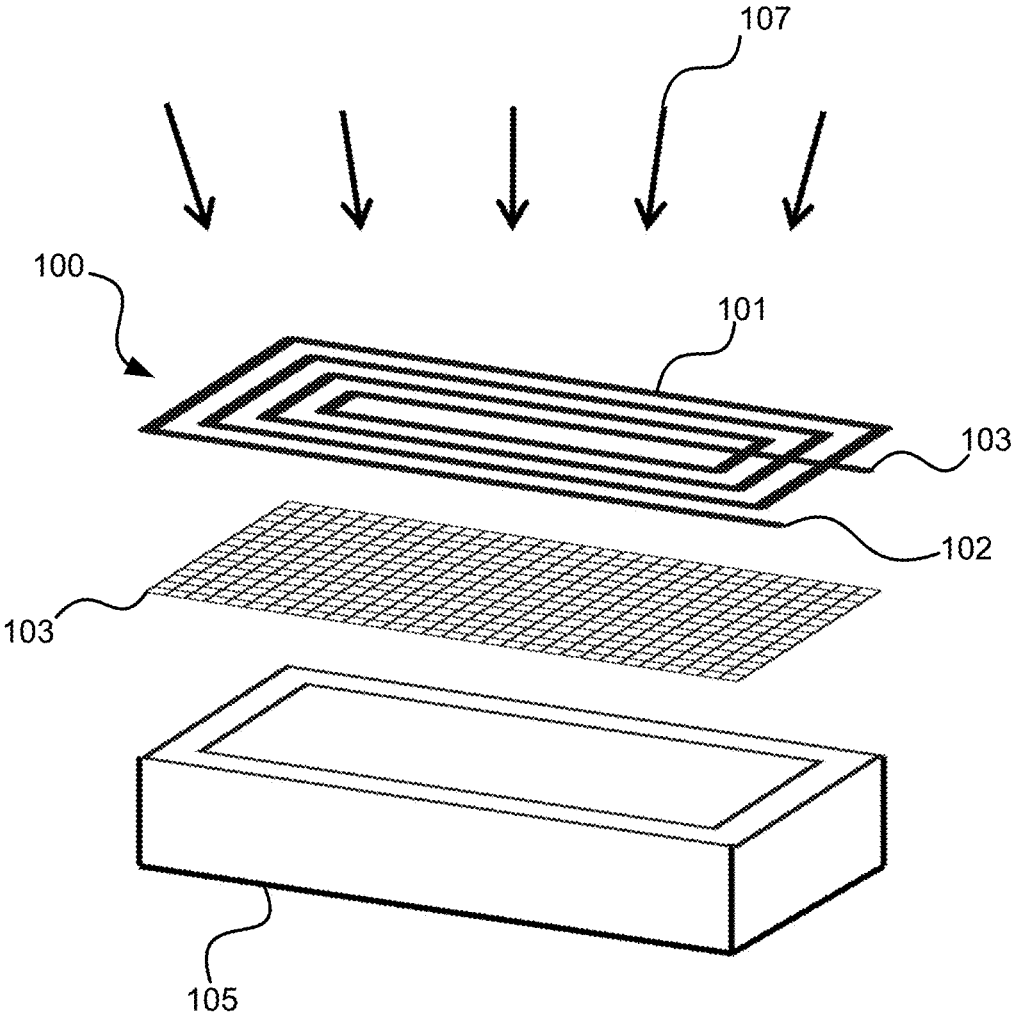
FIG. 14 illustrates a coil and a layer of porous material added on a loudspeaker, which are shown separately, in accordance with an illustrative example.

FIG. 14 illustrates an exploded view of an example of the coil 100 the layer 103 and the loudspeaker 105. In the example of FIG. 14, a planar coil 100, which is made of a high-permeability material, acts to reduce the stray magnetic field pulling in the particles 107, while at the same time working as a coil for HAC or NFC or any other similar function. The layer 103 can support the coil 100 mechanically. The coil 100 may be attached to the layer 103. In the example of FIG. 14 signal lines connected to loudspeaker 105 and planar coil 100 are not shown for the sake of clarity.

Figure 15:
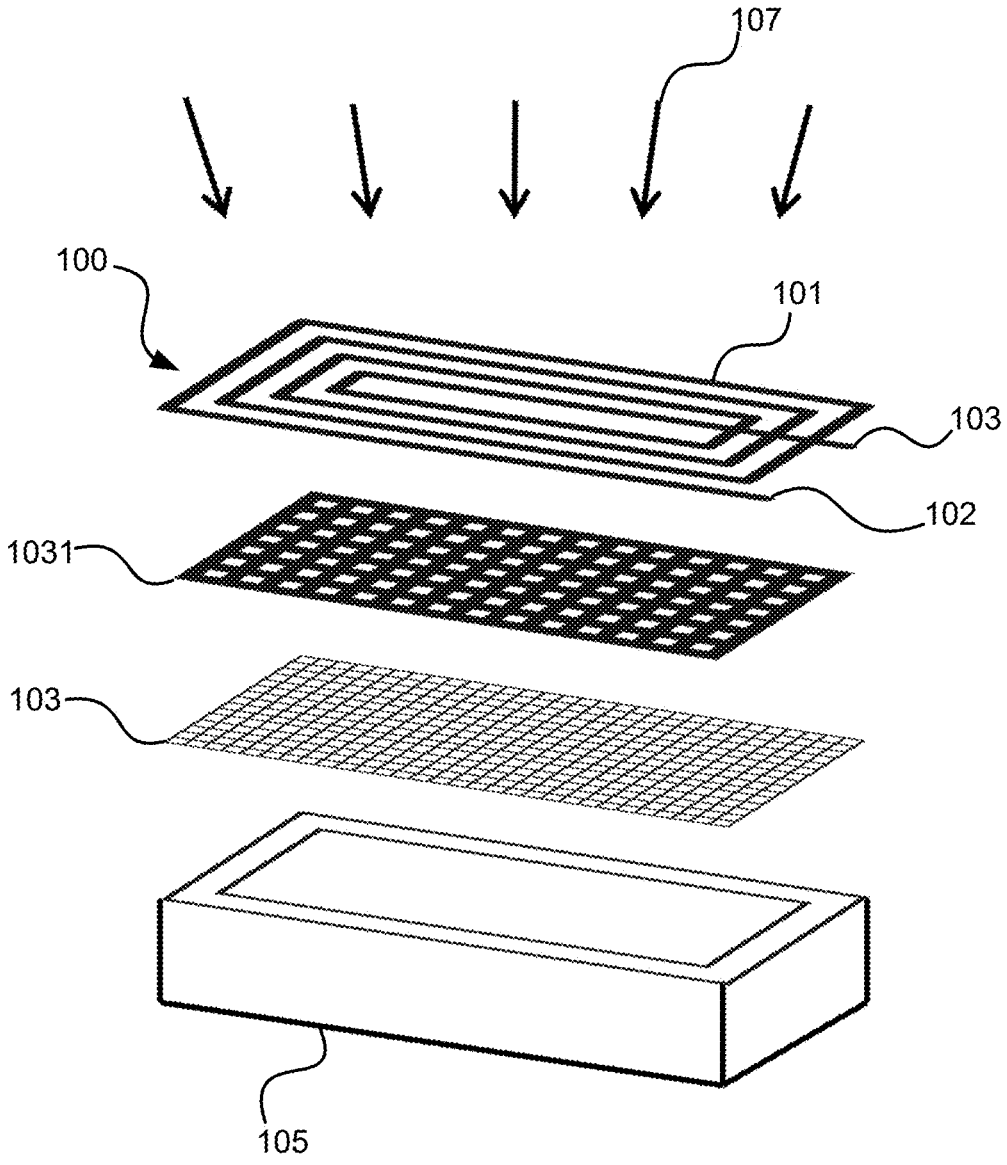
FIG. 15 illustrates a coil, a layer of porous material and a sheet having high-permeability added on a loudspeaker, in accordance with an illustrative example.

FIG. 15 illustrates an exploded view of another example of the coil 100, the layer 103 and the loudspeaker 105 configuration. Here, the planar coil 100 is made of material that does not necessarily have a high permeability, for example copper. A porous sheet of a high-permeability material 1031 is added as a separate part. The porous sheet 1031 can support the coil 100 mechanically. The coil 100 may be attached to the porous sheet 1031. Signal lines, which are connected to loudspeaker 105 and planar coil 100, are not shown.

Figure 16:
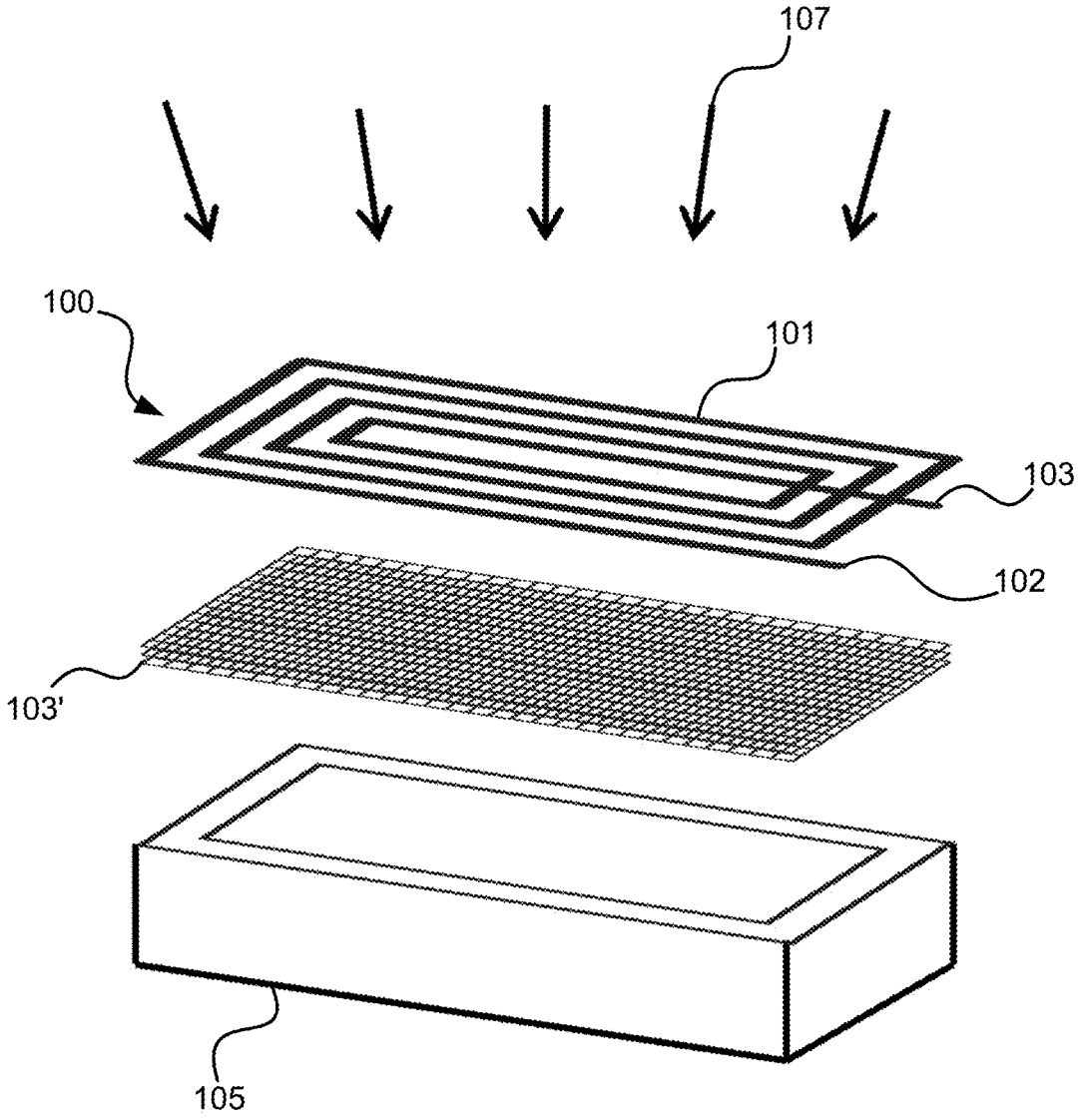
FIG. 16 illustrates a coil and a layer of porous material having a high-permeability added on a loudspeaker, in accordance with an illustrative example.

FIG. 16 illustrates an exploded view of yet another example of the coil 100 and the loudspeaker 105. Here, a layer of porous high-permeability material 103' is chosen to have such a fine structure that a separate dust mesh is not needed, because the porous material itself captures enough dust particles. The porous sheet 103' can support the coil 100 mechanically. The coil 100 may be attached to the porous sheet 103'. Signal lines connected to loudspeaker and planar coil are not shown.

Figure 17:
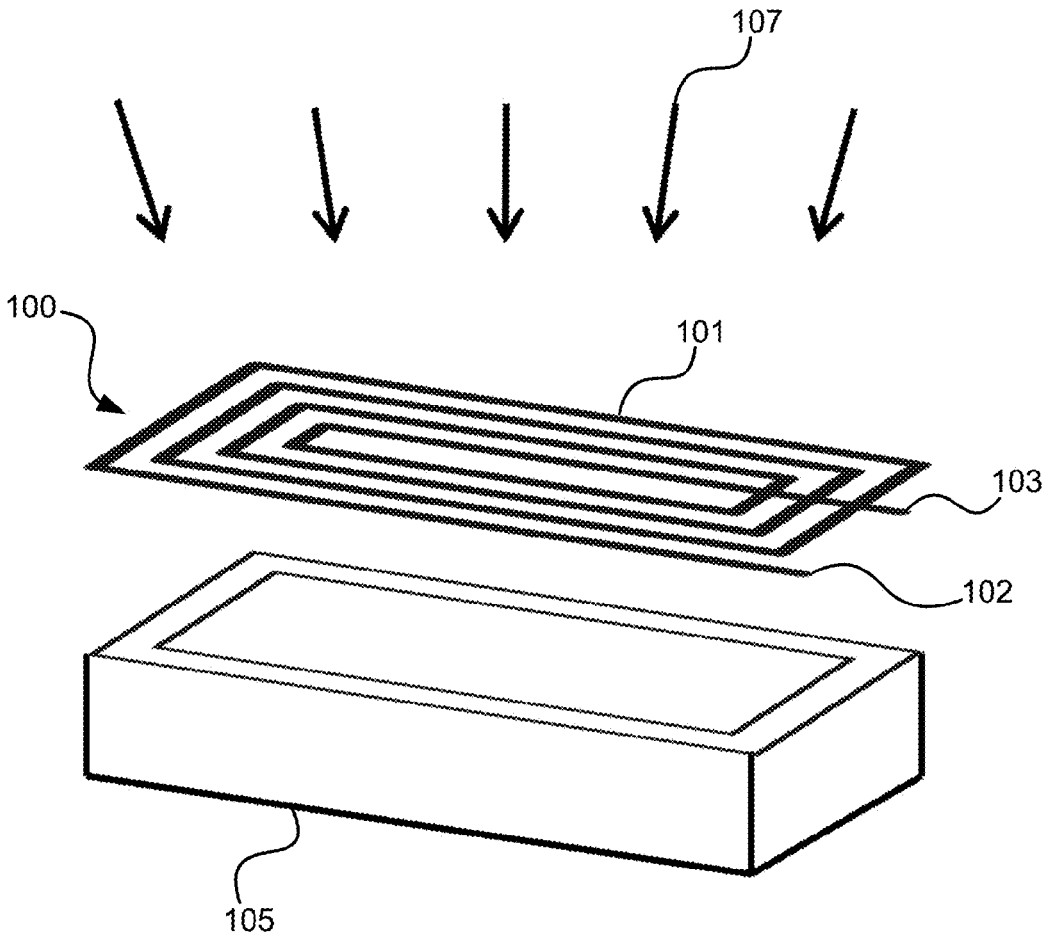
FIG. 17 illustrates a coil added on a loudspeaker, in accordance with an illustrative example.

FIG. 17 illustrates an exploded view of yet another example of the coil 100 and the loudspeaker 105 configuration. Here, the planar coil 100 is made of a high-permeability material and is designed to reduce the stray magnetic field pulling in particles 107 so significantly that an actual dust mesh is no longer needed. Normally the coil 100 still needs some support structure to keep its shape. This could be a sheet of perforated tape etc. (not shown in FIG. 17), to which the planar coil 100 is attached. Alternatively, the coil 100 could be attached to some other part of the apparatus, for example its cover. Signal lines connected to loudspeaker and planar coil are not shown. In the example of FIG. 17, the coil 100 is configured to change a magnetic field 106 of a transducer 105 and change an orientation of the particles so as to capture the particles on the coil 100 itself. Or the coil 100 is configured to change a magnetic field 106 of the transducer 105 so as to change, or reduce, a pulling force of the particles 107.

According to an example, the coil 100 can be driven together with a voice coil inside the loudspeaker 105, so that the coil 100 enhances the magnetic field 015 produced by the loudspeaker voice coil on its own. In this example, the coil 100 may not have to have as many turns of wire, and as thin a wire, as otherwise.

According to an example, a layer of ferrite may be used as an additional backing. The coil 100 is attached on the layer of ferrite. Additionally, the dust mesh 103 can also be attached to the layer of ferrite. The layer of ferrite, or a ferrite sheet, has openings through which sound can pass. The performance of HAC or NFC can be higher, which may be due to proportionally lower resistance and/or higher inductance and/or higher power handling capacity. Furthermore, the ferrite layer and the coil can be configured one and the same.

According to an example, the signal line 101 of the coil 100 is coated with an insulating layer. The insulating layer may be similar to what is used in conventional loudspeaker voice coils. The insulating layer helps to prevent partial short-circuits, which may be a consequence of accumulating metal dust. For example, if any layer adjacent to the coil 100 is conductive, the coil 100 may be electrically insulated from it by the insulating layer. According to another example, the insulating layer may not be applied to the signal line 101 itself, but rather a separate layer, for example a layer of perforated tape, is added above and/or below the coil 100. This may not insulate adjacent turns of the coil 100 from each other; however it may isolate the coil 100 from any conductive material above or below it.

According to an example, the layer of porous material 103 may be smaller than the coil 100. Furthermore, configuration of the other layers 1031, 103', may be smaller, or larger, than the coil 100, for example the layer of ferrite may be smaller than the coil 100.

Figure 18:
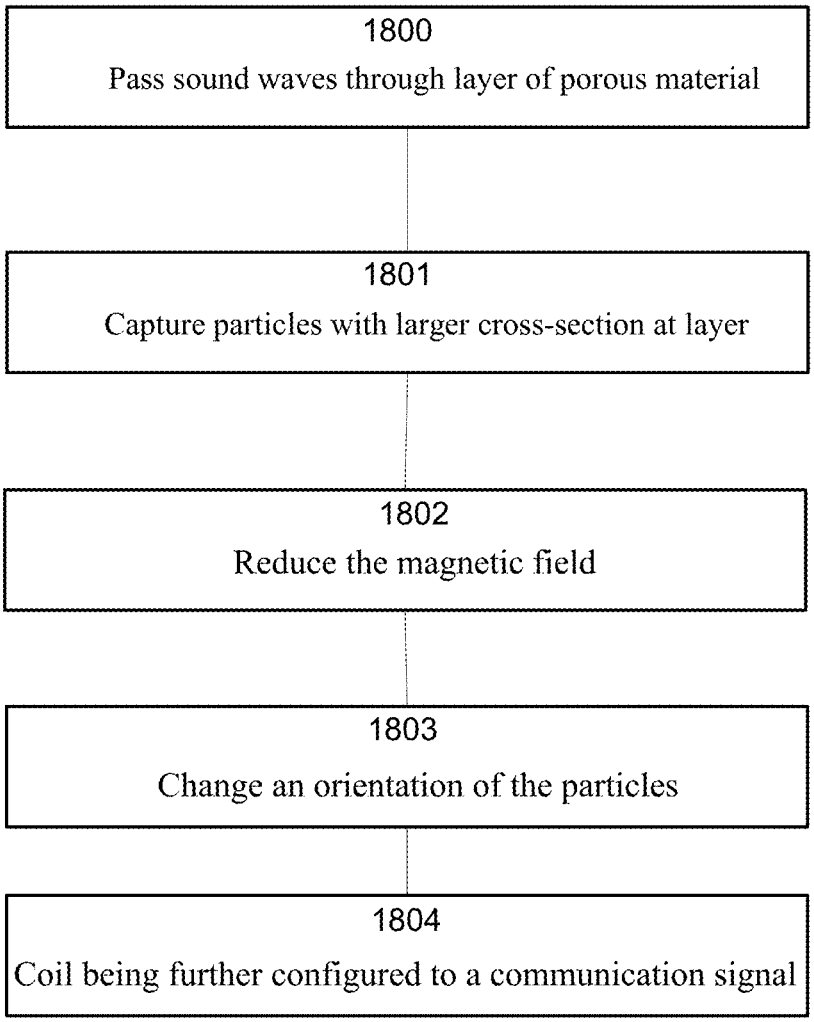
FIG. 18 is a schematic flow diagram of the method, in accordance with an illustrative example.

FIG. 18 is an example of a flow diagram of the method. In the step 1800, the layer of porous material 103 is configured to pass sound waves through it. The layer may comprise openings 104. In the step 1801, particles 107 having a larger cross-section than a width of any of the openings are being captured. In the step 1802, the coil 100 reduces the magnetic field 106. The coil 100 is configured on the layer 103, and a signal line 101 of the coil 100 is configured to conform to a shape of the layer 103 so that the signal line 101 is configured on the layer 103. In the step 1803, the coil 100 is configured to change an orientation of the particles 107 so as to capture the particles 107 on the layer 103. In the step 1804, the coil 100 is further configured to a communication signal such as a HAC or NFC signal.

The term 'computer', 'computing-based device', 'apparatus' or 'mobile apparatus' is used herein to refer to any device with processing capability such that it can execute instructions. Those skilled in the art will realize that such processing capabilities are incorporated into many different devices and therefore the terms 'computer' and 'computing-based device' each include PCs, servers, mobile telephones (including smart phones), tablet computers, set-top boxes, media players, games consoles, personal digital assistants and many other devices.

The methods and functionalities described herein may be performed by software in machine readable form on a tangible storage medium e.g. in the form of a computer program comprising computer program code means adapted to perform all the functions and the steps of any of the methods described herein when the program is run on a computer and where the computer program may be embodied on a computer readable medium. Examples of tangible storage media include computer storage devices comprising computer-readable media such as disks, thumb drives, memory etc. and do not include propagated signals. Propagated signals may be present in a tangible storage media, but propagated signals per se are not examples of tangible storage media. The software can be suitable for execution on a parallel processor or a serial processor such that the method steps may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), Graphics Processing Units (GPUs).

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc.

Any range or device value given herein may be extended or altered without losing the effect sought. Also any example may be combined to another example unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method, blocks or elements identified, but that such blocks or elements do not comprise an exclusive list and a method or apparatus may contain additional blocks or elements.

According to the above, some examples are directed to an apparatus, comprising: a layer of porous material, comprising openings, configured to pass sound waves through the layer and capture particles having a larger dimension than a width of the openings; and a coil configured on the layer, wherein a signal line of the coil is configured to conform to a shape of the layer so that the signal line is configured on the layer; wherein the coil is configured to change a magnetic field of a transducer and change an orientation of the particles so as to capture the particles on the layer. Additionally or alternatively to one or more of the examples, the coil comprises a planar coil. Additionally or alternatively to one or more of the examples, the coil comprises a planar spiral coil. Additionally or alternatively to one or more of the examples, the coil comprises a double coil so that two layers of the signal line are configured on the layer of porous material. Additionally or alternatively to one or more of the examples, the coil is driven together with the transducer so that the magnetic field is enhanced. Additionally or alternatively to one or more of the examples, the coil is configured to substantially cover an area of the layer of porous material. Additionally or alternatively to one or more of the examples, the coil is configured to a different area size than an area size of the layer of porous material. Additionally or alternatively to one or more of the examples, the coil comprises at least one of: ferrite material; material with high magnetic permeability; stainless steel SUS 430; mu metal; or copper. Additionally or alternatively to one or more of the examples, the layer of porous material is configured as a dust mesh. Additionally or alternatively to one or more of the examples, further including a layer of ferrite, onto which the layer of porous material or the coil is attached. Additionally or alternatively to one or more of the examples, further including an insulating layer, which is configured to coat the coil. Additionally or alternatively to one or more of the examples, the coil is further configured to orientate the magnetic field so as to change the orientation of the particles. Additionally or alternatively to one or more of the examples, the coil is further configured to orientate the magnetic field towards an orientation of the layer of porous material. Additionally or alternatively to one or more of the examples, the particles include a magnetic portion so as to orientate the particles based on the changed magnetic field. Additionally or alternatively to one or more of the examples, the particles are elongated particles so that when an orientation of the particles changes, the particles do not pass through the layer of porous material. Additionally or alternatively to one or more of the examples, the coil is further configured to a communication signal, the communication signal is configured to hearing aid compatibility, HAC, and the coil is configured to operate as a HAC coil. Additionally or alternatively to one or more of the examples, the coil is further configured to a communication signal, the communication signal is configured to near field communications, NFC, and the coil is configured to operate as a NFC antenna. Additionally or alternatively to one or more of the examples, the coil comprises coil openings configured to pass the sound waves through the coil and capture the particles having the larger dimension than a width of the openings.

Some examples are directed to a magnetic coil, comprising: a signal line configured to pass sound waves through the coil and capture particles on the coil, wherein the coil is configured to change a magnetic field proximate to the coil and change an orientation of the particles so as to capture the particles on the coil, and wherein the coil is further configured to a communication signal.

Some examples are directed to a method, comprising: passing sound waves through a layer of porous material, comprising openings; capturing particles having a larger dimension than a width of the openings; changing a magnetic field of a transducer by a coil, wherein the coil is configured on the layer, and wherein a signal line of the coil is configured to conform to a shape of the layer so that the signal line is configured on the layer; changing an orientation of the particles so as to capture the particles on the layer; and configuring the coil to a communication signal.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. An apparatus, comprising:

a layer of porous material, comprising openings, configured to pass sound waves through the layer and capture particles having a larger dimension than a width of the openings; and a coil configured on the layer, wherein a signal line of the coil is configured to conform to a shape of the layer so that the signal line is configured on the layer;

wherein the coil is configured to change a magnetic field of a transducer and change an orientation of the particles so as to capture the particles on the layer.

2. The apparatus of claim 1, wherein the coil comprises a planar coil.

3. The apparatus of claim 1, wherein the coil comprises a planar spiral coil.

4. The apparatus of claim 1, wherein the coil comprises a double coil so that two layers of the signal line are configured on the layer of porous material.

5. The apparatus of claim 1, wherein the coil is driven together with the transducer so that the magnetic field is enhanced.

6. The apparatus of claim 1, wherein the coil is configured to substantially cover an area of the layer of porous material.

7. The apparatus of claim 1, wherein the coil is configured to a different area size than an area size of the layer of porous material.

8. The apparatus of claim 1, wherein the coil comprises at least one of:

ferrite material;

material with high magnetic permeability;

stainless steel SUS 430;

mu metal; or copper.

9. The apparatus of claim 1, wherein the layer of porous material is configured as a dust mesh.

10. The apparatus of claim 1, further including a layer of ferrite, onto which the layer of porous material or the coil is attached.

11. The apparatus of claim 1, further including an insulating layer, which is configured to coat the coil.

12. The apparatus of claim 1, wherein the coil is further configured to orientate the magnetic field so as to change the orientation of the particles.

13. The apparatus of claim 1, wherein the coil is further configured to orientate the magnetic field towards an orientation of the layer of porous material.

14. The apparatus of claim 1, wherein the particles include a magnetic portion so as to orientate the particles based on the changed magnetic field.

15. The apparatus of claim 1, wherein the particles are elongated particles so that when an orientation of the particles changes, the particles do not pass through the layer of porous material.

16. The apparatus of claim 1, wherein the coil is further configured to a communication signal, the communication signal is configured to hearing aid compatibility, HAC, and the coil is configured to operate as a HAC coil.

17. The apparatus of claim 1, wherein the coil is further configured to a communication signal, the communication signal is configured to near field communications, NFC, and the coil is configured to operate as a NFC antenna.

18. The apparatus of claim 1, wherein the coil comprises coil openings configured to pass the sound waves through the coil and capture the particles having the larger dimension than a width of the openings.

19. A magnetic coil, comprising:

a signal line configured to pass sound waves through the coil and capture particles on the coil, wherein the coil is configured to change a magnetic field proximate to the coil and change an orientation of the particles so as to capture the particles on the coil.

20. A method, comprising:

passing sound waves through a layer of porous material, comprising openings;

capturing particles having a larger dimension than a width of the openings;

changing a magnetic field of a transducer by a coil, wherein the coil is configured on the layer, and wherein a signal line of the coil is configured to conform to a shape of the layer so that the signal line is configured on the layer; and changing an orientation of the particles so as to capture the particles on the layer.

* * * * *